US009229429B2

(12) United States Patent
Akatsuka et al.

(10) Patent No.: US 9,229,429 B2
(45) Date of Patent: Jan. 5, 2016

(54) IMAGE FORMING APPARATUS INCLUDING AN AIR-BLOWING PORTION CONFIGURED TO BLOW AIR GUIDED TO A RECORDING MATERIAL

(71) Applicant: CANON KABUSHIKI KAISHA, Tokyo (JP)

(72) Inventors: Junya Akatsuka, Kawasaki (JP); Masaki Tanaka, Kawasaki (JP); Daisuke Aoki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/224,413

(22) Filed: Mar. 25, 2014

(65) Prior Publication Data

US 2014/0294474 A1 Oct. 2, 2014

(30) Foreign Application Priority Data

Apr. 1, 2013 (JP) ..... 2013-075601

(51) Int. Cl.

| | |
|---|---|
| ***G03G 15/00*** | (2006.01) |
| ***B65H 29/00*** | (2006.01) |
| ***G03G 21/20*** | (2006.01) |
| *G03G 15/20* | (2006.01) |

(52) U.S. Cl.

CPC ..... *G03G 21/206* (2013.01); *G03G 15/2017* (2013.01)

(58) Field of Classification Search

CPC ..... G03G 21/0206; G03G 15/2017
USPC ..... 399/405, 341; 271/211
See application file for complete search history.

(56) References Cited

U.S. PATENT DOCUMENTS

| | | | | |
|---|---|---|---|---|
| 7,519,320 | B2 | 4/2009 | Aoki et al. | |
| 7,650,105 | B2 | 1/2010 | Ogawa et al. | |
| 8,364,067 | B2 | 1/2013 | Miki et al. | |
| 8,532,530 | B2 | 9/2013 | Nishida et al. | |
| 8,655,213 | B2 | 2/2014 | Tanaka et al. | |
| 8,666,273 | B2 | 3/2014 | Tanaka | |
| 2012/0155938 | A1 | 6/2012 | Tanaka et al. | |
| 2012/0308279 | A1 | 12/2012 | Tanaka et al. | |
| 2013/0129364 | A1 | 5/2013 | Kitagawa et al. | |
| 2013/0206745 | A1 | 8/2013 | Tanaka et al. | |
| 2013/0228965 | A1 * | 9/2013 | Hoshino et al. | 271/211 |
| 2013/0236228 | A1 * | 9/2013 | Nagasako et al. | 399/405 |
| 2013/0272762 | A1 | 10/2013 | Uekawa et al. | |
| 2013/0302046 | A1 | 11/2013 | Monde et al. | |
| 2014/0105634 | A1 | 4/2014 | Tanaka et al. | |

FOREIGN PATENT DOCUMENTS

JP 2005-77565 A 3/2005

OTHER PUBLICATIONS

U.S. Appl. No. 14/159,686 to Masanobu Tanaka, filed Jan. 21, 2014.

* cited by examiner

*Primary Examiner* — Quana M Grainger
(74) *Attorney, Agent, or Firm* — Fitzpatrick, Cella, Harper & Scinto

(57) ABSTRACT

An image forming apparatus heats and fixes a toner image on a recording material, discharges and cools the recording material, and prevents the heated and fixed toner image on the recording material from being melted. The apparatus also has a conveying portion that is prevented from being cooled, so that unevenness of cooling of the toner image is prevented, and the image forming apparatus does not cause any contact mark of the conveying portion.

22 Claims, 7 Drawing Sheets

IMAGE FORMING APPARATUS INCLUDING AN AIR-BLOWING PORTION CONFIGURED TO BLOW AIR GUIDED TO A RECORDING MATERIAL

BACKGROUND OF THE INVENTION

1. Field of the Invention

The present invention relates to an image forming apparatus for forming a toner image on a recording material.

2. Description of the Related Art

A recording material discharged immediately after a toner image formed on the recording material has been heated and fixed is at a high temperature. In normal circumstances, immediately after the heating and fixing process, the recording material is discharged to a discharge tray by, e.g., a discharge roller. Accordingly, high-temperature recording materials are stacked on the discharge tray, and the toner image that has been heated and fixed onto the recording material may be melted again by the high-temperature recording materials that have been discharged, and the toner image may stick to the back surface of the recording material.

In order to solve such a problem, external air that has been drawn by, e.g., a fan, is blown onto the recording materials discharged onto the discharge tray to cool the recording materials, so that the toner image that has been heated and fixed on the recording material is prevented from being melting again.

For example, Japanese Patent Laid-Open No. 2005-77565 indicates that a cooling fan cools a portion around a discharge roller provided downstream of a fixing device, and in accordance with whether a discharge device is attached or not, the flow of air from the cooling fan is changed.

When a high-temperature recording material is stacked on a discharge tray, a toner image heated and fixed on the recording material is melted again by high-temperature, previously-discharged recording materials. Accordingly, the toner image attaches to the back surface of the recording material. In order to prevent this, the recording material is cooled by blowing external air, which is retrieved by, e.g., a fan, onto the recording material discharged onto the discharge tray, and the toner image heated and fixed on the recording material is prevented from being melted again.

However, when the recording material is cooled, the discharge roller and the like are also cooled, and therefore, unevenness of cooling occurs in the toner image because of the difference in the temperature between the recording material discharged immediately after the heating and fixing process and the discharge roller and the discharge driven roller, and failure may occur in the image, e.g., the occurrence of contact marks of the discharge roller and the discharge driven roller.

The present invention solves the above problem, and it is desirable to cool the recording material on which the toner image has been heated and fixed and which has been discharged, and the toner image, which has been heated and fixed on the recording material, is prevented from being melted again. Further, the present invention provides an image forming apparatus that prevents the conveying portion from being cooled, thus preventing unevenness of cooling of the toner image, and preventing the making of any contact mark of the conveying portion.

SUMMARY OF THE INVENTION

A representing configuration of an image forming apparatus according to the present invention for achieving the above object includes a toner image forming portion configured to form a toner image on a recording material, a fixing portion configured to fix the toner image formed by the toner image forming portion onto the recording material, a pair of rollers which is provided downstream in a conveying direction of a recording material with respect to the fixing portion, and which sandwiches and conveys the recording material, an air-blowing portion configured to blow air, and a guide portion configured to guide air blown by the air-blowing portion to a recording material conveyed by the pair of rollers. The guide portion includes a blowing port in proximity to the pair of rollers and at a position avoiding the pair of rollers.

Further features of the present invention will become apparent from the following description of exemplary embodiments with reference to the attached drawings.

DESCRIPTION OF THE EMBODIMENTS

Embodiments of an image forming apparatus according to the present invention will be described with reference to drawings in a more specific manner.

[First Embodiment] First, a configuration of the first embodiment of an image forming apparatus according to the present invention will be described with reference to FIGS. 1 to 4. In the present embodiment, an example in a case where the present embodiment is applied to a full-color laser beam printer will be described as an example of an image forming apparatus 100. It should be noted that the image forming apparatus 100 can be applied not only to a full color laser beam printer, but also to various kinds of image forming apparatuses such as a color electrophotographic copying machine and a facsimile device.

Figure 1:
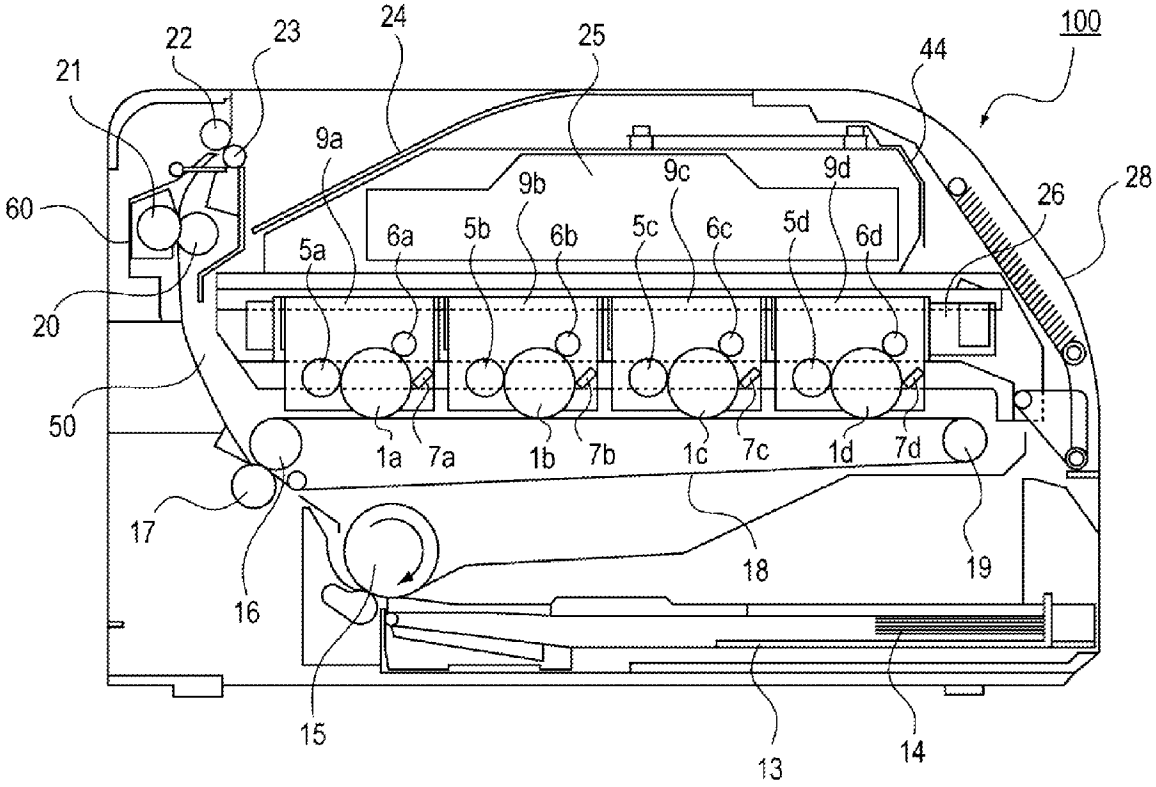
FIG. 1 is a sectional explanatory diagram illustrating a configuration of an image forming apparatus according to the present invention.

<Image forming apparatus> First, a configuration of a color electrophotographic image forming apparatus (which will be hereinafter referred to as "image forming apparatus") 100 will be described with reference to FIG. 1. FIG. 1 is a sectional explanatory diagram illustrating a configuration of the image forming apparatus 100. It should be noted that the main body of the image forming apparatus 100 is a configuration obtained by removing process cartridges 9*a*, 9*b*, 9*c*, 9*d* and a cartridge tray 26 serving as a cartridge support member from the image forming apparatus 100. It should be noted that, for the sake of description, the process cartridges 9*a*, 9*b*, 9*c*, 9*d* may be referred to as process cartridges 9 that simply represent the process cartridges 9*a*, 9*b*, 9*c*, 9*d* . This is also applicable to other image forming process portions.

It should be noted that, in the description below, the closer side (forward side) of the image forming apparatus 100 is a side where a door 28 serving as an open/close member configured to be able to open/close is provided on the main body of the image forming apparatus 100 (right side of FIG. 1). It should be noted that the door 28 closes, in an openable manner, an opening provided in an external wall 44 of the main body of the image forming apparatus 100. The farther side (backward side) of the main body of the image forming apparatus 100 is a side where a conveying path 50 for a recording material 14 is provided (left side of FIG. 1) and which is the opposite to the side where the door 28 is provided.

In the main body of the image forming apparatus 100, e.g., a sheet cassette 13 accommodating the recording materials 14, a feeding/conveying roller 15, an intermediate transfer belt 18, a fixing film 20 and a pressure roller 21 constituting a fixing device 60 serving as a fixing portion, and a laser scanner 25 are provided. The main body of the image forming apparatus 100 is also provided with a cartridge tray 26 provided to be movable. The cartridge tray 26 supports, in a detachable manner, the process cartridges 9 serving as a toner image forming portion which forms a toner image onto the recording material 14.

The process cartridges 9 include photosensitive drums 1*a*, 1*b*, 1*c*, 1*d* serving as image bearing members made of drum-shaped electrophotographic photosensitive bodies and developing rollers 5*a*, 5*b*, 5*c*, 5*d* serving as developing members constituting image forming process portions exerting on the photosensitive drums 1*a*, 1*b*, 1*c*, 1*d* respectively. Further, charging rollers 6*a*, 6*b*, 6*c*, 6*d*, serving as charging members and cleaning blades 7*a*, 7*b*, 7*c*, 7*d* serving as cleaning members are integrally provided to the photosensitive drums 1*a*, 1*b*, 1*c*, 1*d* respectively. Each process cartridge 9 is detachably attached to the cartridge tray 26, and is attached to an image forming position in the main body of the image forming apparatus 100.

The recording materials 14 stacked in the sheet cassette 13 are fed and conveyed by the feeding/conveying roller 15 rotating in a clockwise direction of FIG. 1, and is conveyed to a transfer nip portion between the driving roller 16 of the intermediate transfer belt 18 and the transfer roller 17 serving as a transfer portion. The photosensitive drums 1*a*, 1*b*, 1*c*, and 1*d* start rotation in a counterclockwise direction of FIG. 1, and the external peripheral surface thereof is charged by the charging rollers 6*a*-6*d*, respectively. Laser light is emitted by the laser scanner 25, serving as an exposure portion, onto the photosensitive drums 1*a*-1*d* , which have been charged, in accordance with image information.

Accordingly, electrostatic latent images are formed on the surfaces of the photosensitive drums 1*a*-1*d* in order. Subsequently, toner serving as developer is supplied by a developing rollers 5*a*-5*d* to the surface of the photosensitive drums 1*a*-1*d*, respectively , so that the electrostatic latent images are developed. Accordingly, the toner images are formed on the external peripheral surfaces of the photosensitive drums 1*a*-1*d*. It should be noted that the process cartridges 9 are the same except that the colors of the developers contained within the developer containers are different.

The process cartridge 9*a* contains developer in yellow color, and forms a toner image in yellow color on the photosensitive drum 1*a*. The process cartridge 9*b* contains developer in magenta color, and forms a toner image in magenta color on the photosensitive drum 1*b*. The process cartridge 9*c* contains developer in cyan color, and forms a toner image in cyan color on the photosensitive drum 1*c*. The process cartridge 9*d* contains developer in black color, and forms a toner image in black color on the photosensitive drum 1*d*.

A toner image formed on the surface of the photosensitive drum 1*d* is transferred onto the external peripheral surface of the intermediate transfer belt 18 when a monochrome image is formed. When a color image is formed, toner images in yellow color, magenta color, cyan color, and black color formed on the photosensitive drums 1*a*-1*d* are primarily transferred onto the external peripheral surface of the intermediate transfer belt 18 in a sequentially superimposed manner. The intermediate transfer belt 18 is an endless belt rotating and moving by being in contact with each photosensitive drums 1*a*-1*d* , and is wrapped around the driving roller 16, the tension roller 19, and the like in a tensional manner.

The toner image transferred onto the external peripheral surface of the intermediate transfer belt 18 is secondarily transferred onto the recording material 14 that is fed to the transfer nip portion between the driving roller 16 and the transfer roller 17. The recording material 14 having the toner image transferred thereon is conveyed to the fixing nip portion between the fixing film 20 and the pressure roller 21, and is heated and pressurized at the fixing nip portion between the fixing film 20 and the pressure roller 21.

Accordingly, the toner image formed by, e.g., the process cartridge 9 and the laser scanner 25 constituting the toner image forming portion is transferred by, e.g., the intermediate transfer belt 18 and the transfer roller 17 onto the recording material 14, and the toner image is fixed onto the recording material 14 by the fixing device 60 serving as a fixing portion. Accordingly, the color image is formed on the recording material 14. When a monochrome image is formed on the recording material 14, only a toner image in black color may be formed on the photosensitive drum 1*d*, and the toner image may be transferred onto the recording material 14.

<Conveying portion> The recording material 14 having the toner image fixed thereon is discharged to a stacking portion 24 by the discharge roller 22 and the discharge driven roller 23 serving as a pair of rollers constituting a conveying portion. The external periphery of the discharge drive roller 23 is in contact with the surface of the recording material 14 where the image is formed. The discharge roller 22 and the discharge driven roller 23 serving as a pair of rollers constituting the conveying portion are provided downstream of the fixing device 60 in the conveying direction of the recording material and in proximity to the fixing device 60, and the discharge roller 22 and the discharge driven roller 23 serve as a pair of rollers constituting the conveying portion to sandwich and convey the recording material 14.

Figure 2:
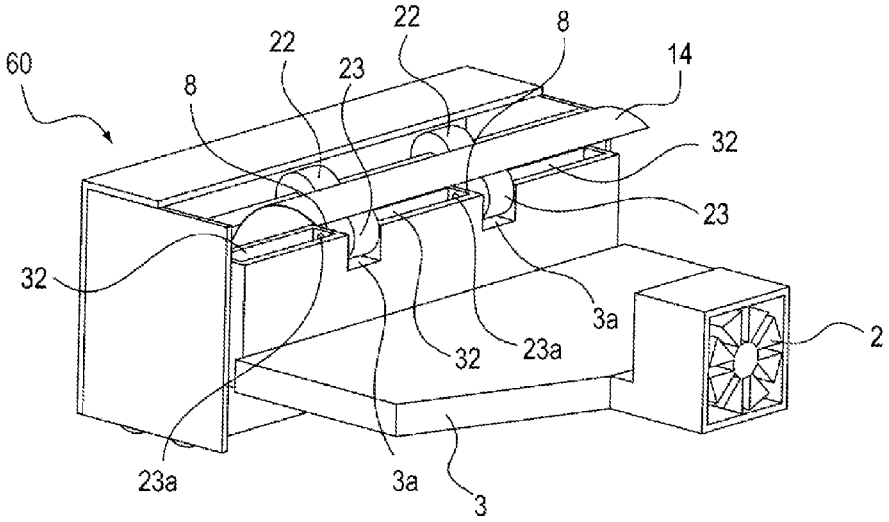
FIG. 2 is a perspective explanatory diagram illustrating a configuration in proximity to a conveying portion according to a first embodiment of the image forming apparatus according to the present invention.
Figure 3:
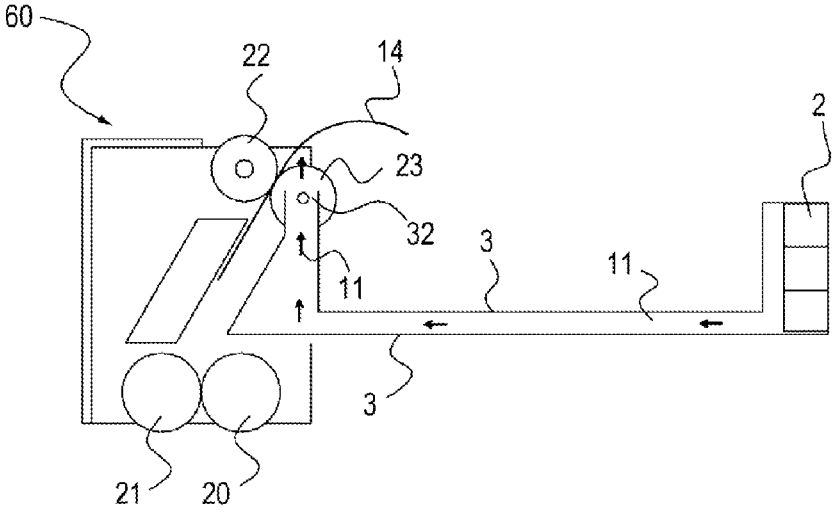
FIG. 3 is a sectional explanatory diagram illustrating a configuration in proximity to a conveying portion of the image forming apparatus of the first embodiment.
Figure 4:
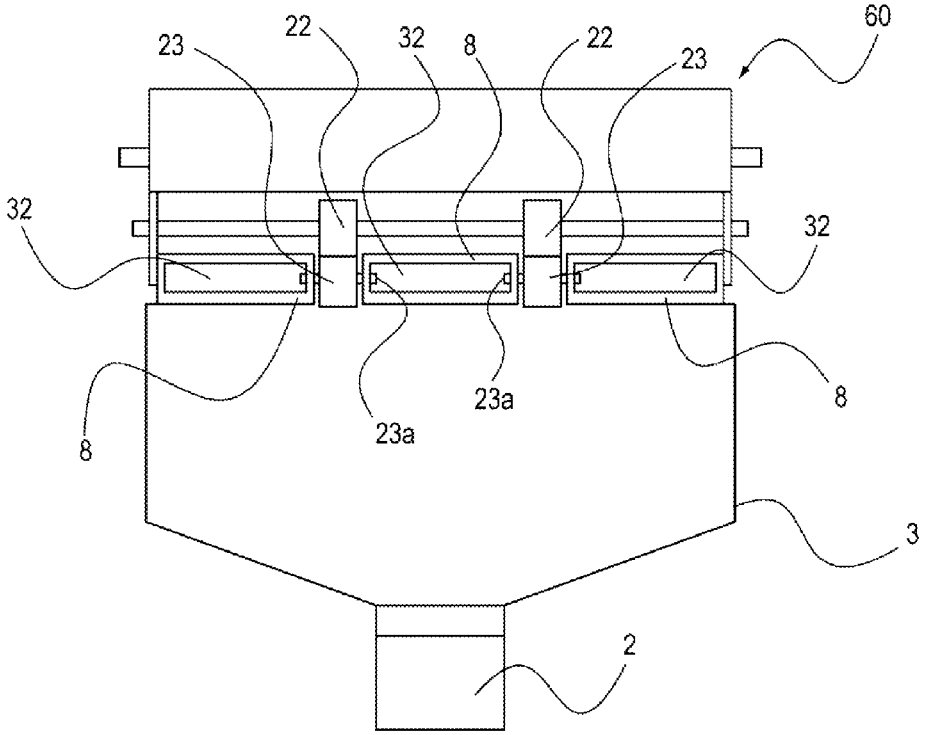
FIG. 4 is a top view explanatory diagram illustrating a configuration in proximity to the conveying portion of the image forming apparatus of the first embodiment.

<Cooling portion> FIG. 2 is a perspective explanatory diagram illustrating a configuration of a cooling portion provided in proximity to the conveying portion of the first embodiment. FIG. 3 is a sectional explanatory diagram illustrating a configuration of the cooling portion provided in proximity to the conveying portion of the first embodiment. FIG. 4 is a top view explanatory diagram illustrating a configuration of the cooling portion provided in proximity to the conveying portion of the first embodiment.

The recording material 14 on which the toner image is fixed by the fixing device 60 is sandwiched and conveyed by the discharge roller 22 and the discharge driven roller 23 constituting the pair of rollers serving as a conveying portion rotated by a driving source such as a motor, not shown. Then, the recording material 14 is stacked on the stacking portion 24.

At this occasion, as illustrated in FIG. 3, external air 11 drawn by an air-blowing fan 2, serving as an air-blowing portion, which blows air, is introduced into an air-blowing duct 3. The air-blowing duct 3 is coupled with the air-blowing fan 2, and is configured as a guide portion which guides the external air 11 (air) blown by the air-blowing fan 2 to the recording material 14 sandwiched and conveyed by the discharge roller 22 and the discharge driven roller 23 serving as a conveying portion.

At a terminating end portion of the air-blowing duct 3, a blowing port 32 is provided in proximity to the discharge roller 22 and the discharge driven roller 23. The blowing port 32 is made as an opening facing toward the recording material 14 sandwiched and conveyed by the discharge roller 22 and the discharge driven roller 23. As illustrated in FIG. 4, the blowing port 32 of the present embodiment is an opening at a position which located to avoid the discharge roller 22 and the discharge driven roller 23 serving as a pair of rollers.

The blowing port 32 is arranged to be aligned with the discharge roller 22 and the discharge driven roller 23 in the axial direction of the discharge roller 22 and the discharge driven roller 23. The blowing port 32 is also provided between plural discharge driven rollers 23 in the axial direction of the discharge driven roller 23. As illustrated in FIG. 4, the blowing port 32 is arranged inside of the external peripheral surface of the discharge driven roller 23 in the diameter direction of the discharge driven roller 23 (the conveying direction of the recording material). More specifically, the blowing port 32 is arranged at a position overlapping the discharge driven roller 23 in the diameter direction (position overlapping the discharge driven roller 23 as seen in the direction along the axial direction).

As illustrated in FIG. 2, the external air 11 introduced from the air-blowing fan 2 to the air-blowing duct 3 is discharged from the blowing port 32 divided into three parts in the axial direction of the discharge roller 22 and the discharge driven roller 23 provided within the fixing device 60. In the present embodiment, a rotation shaft 23*a* of the discharge driven roller 23 is rotatably, axially supported by an air-discharge wall 8 constituting a portion of the blowing port 32. A closing portion 3*a* for closing the blown air is provided at a position of the air-blowing duct 3 that faces the discharge driven roller 23.

As illustrated in FIG. 3, the external air 11 discharged from the blowing port 32 is blown in a direction indicated by arrows in FIG. 3 to the surface of the recording material 14 discharged by the discharge roller 22 and the discharge driven roller 23 in the fixing device 60, so that the recording material 14 is cooled.

At this occasion, the external air 11 drawn by the air-blowing fan 2 is blown through the blowing port 32 of the air-blowing duct 3 to the recording material 14 sandwiched and conveyed by the discharge roller 22 and the discharge driven roller 23. However, a portion facing the discharge driven roller 23 is closed by the closing portion 3*a*, and therefore, the discharge roller 22 and the discharge driven roller 23 are not directly exposed to the external air 11 blown through the air-blowing duct 3. For this reason, the discharge roller 22 and the discharge driven roller 23, to which the external air 11 is not directly blown, are not cooled.

The air which is blown out of the blowing port 32 and is blown to the lower surface of the recording material 14, sandwiched and conveyed by the discharge roller 22 and the discharge driven roller 23, flows along the lower surface of the recording material 14, which is being discharged, and flows to the upper side of the stacking portion 24. The air-blow direction is configured such that a component in a direction along the nip line of the discharge roller 22 and the discharge driven roller 23 exists as a component of the air-blow direction which is blown from the blowing port 32 of the air-blowing duct 3.

Therefore, the toner image heated and pressurized by the fixing film 20 and the pressure roller 21 of the fixing device 60 is fixed to the recording material 14. Thereafter, the toner image is prevented from being melted again, because of the high-temperature recording material 14 sandwiched and conveyed by the discharge roller 22 and the discharge driven roller 23 and discharged onto the stacking portion 24.

Further, the temperature difference between the recording material 14 discharged immediately after the heating and fixing process in the fixing device 60 and the discharge driven roller 23 and discharge roller 22 can be reduced, and unevenness of cooling of the toner image due to the temperature difference between the recording material 14 and the discharge driven roller 23 and discharge roller 22 can be prevented.

[Second Embodiment] Subsequently, a configuration of the second embodiment of the image forming apparatus according to the present invention will be described with reference to FIGS. 5 to 7. It should be noted that those elements configured in the same manner as those of the first embodiment are denoted with the same reference numerals, or although denoted with different reference numerals, the same member names are given thereto, and the description thereabout will not be repeated here.

Figure 5:
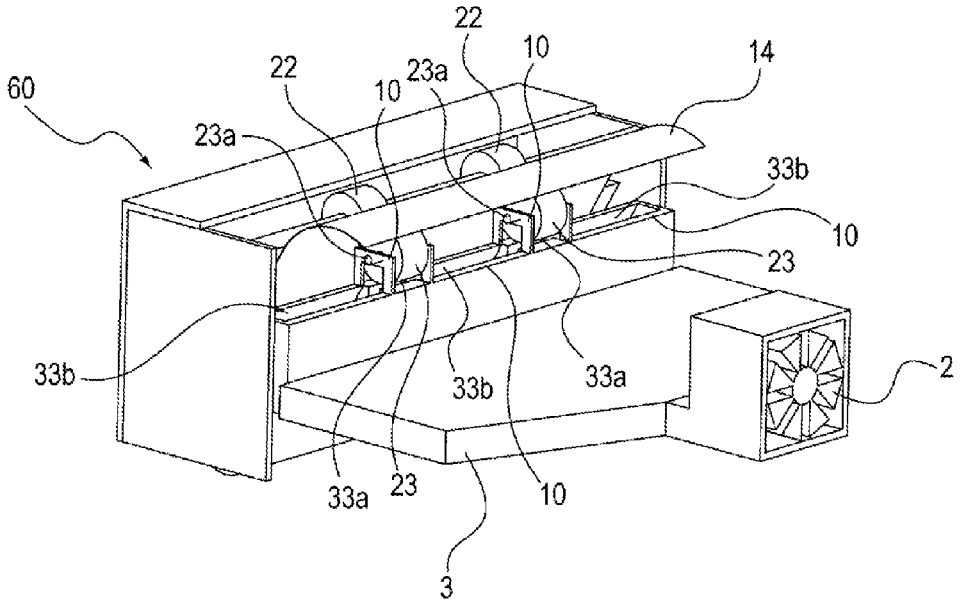
FIG. 5 is a perspective explanatory diagram illustrating a configuration in proximity to a conveying portion of a second embodiment of the image forming apparatus according to the present invention.

FIG. 5 is a perspective explanatory diagram illustrating a configuration around a discharge portion of an image forming apparatus according to the present embodiment. FIG. 6 is a top view explanatory diagram illustrating a configuration around the discharge portion of the image forming apparatus according to the present embodiment. FIG. 7 is a top view explanatory diagram illustrating a configuration around the blowing port according to the present embodiment.

In the present embodiment, at a terminating end portion of an air-blowing duct 3, blowing ports 33*a*, 33*b* are provided in proximity to a discharge roller 22 and a discharge driven roller 23. The blowing ports 33*a*, 33*b* are made as an opening facing toward a recording material 14 sandwiched and conveyed by the discharge roller 22 and the discharge driven roller 23.

External air 11 drawn by an air-blowing fan 2 reaches blowing ports 33*a*, 33*b* via the air-blowing duct 3. The second embodiment has the same configuration as the first embodiment in that the external air is blown through the blowing ports 33*a*, 33*b* to the recording material 14 sandwiched and conveyed by the discharge roller 22 and the discharge driven roller 23 to cool the recording material 14.

Figure 7:
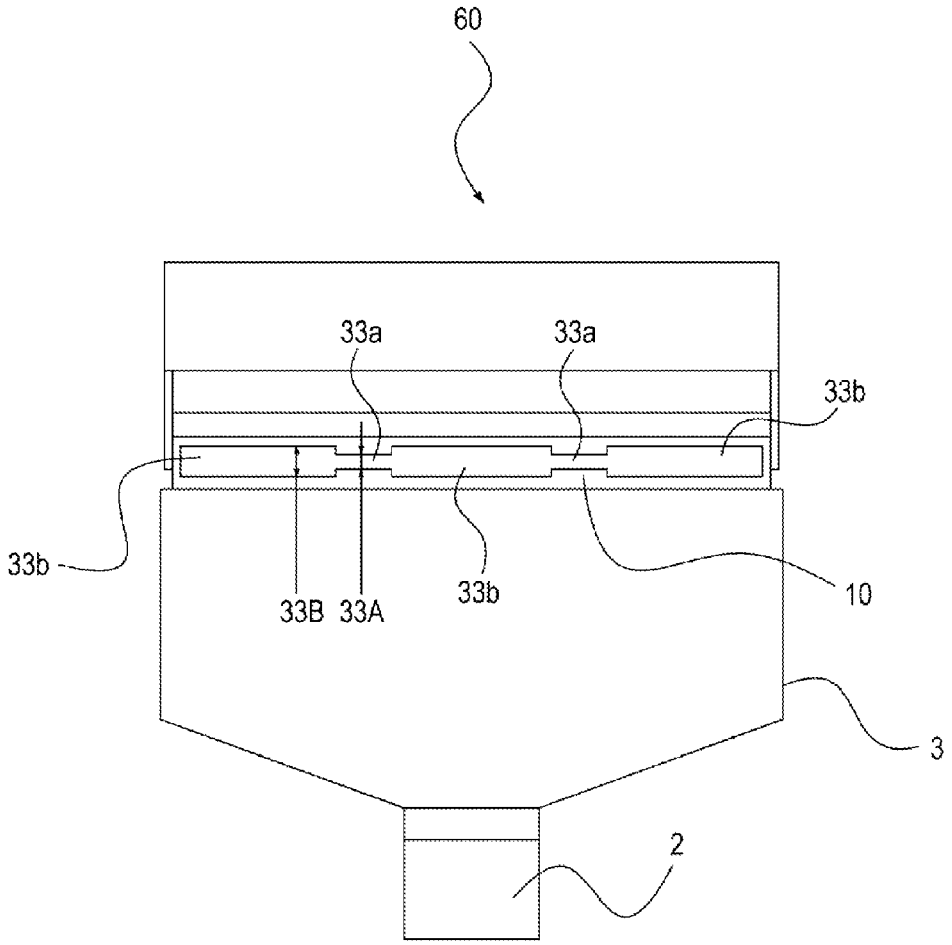
FIG. 7 is a top view explanatory diagram illustrating a configuration of an opening width, in the recording material conveying direction, of the blowing port of the image forming apparatus of the second embodiment at a position facing the pair of rollers, and an opening width, in the recording material conveying direction, of the blowing port of the image forming apparatus of the second embodiment at the position not facing the pair of rollers.

As illustrated in FIG. 7, the blowing ports 33*a*, 33*b* of the present embodiment are configured such that an opening width 33A in the recording material conveying direction (the vertical direction of FIG. 7) of the blowing port 33*a* at a position facing the discharge roller 22 and the discharge driven roller 23, serving as a pair of rollers, is smaller than an opening width 33B of the blowing port 33*b*. The opening width 33B is an opening width in the recording material conveying direction (the vertical direction of FIG. 7) of the blowing port 33*b* at a position not facing the discharge roller 22 and the discharge driven roller 23.

Figure 6:
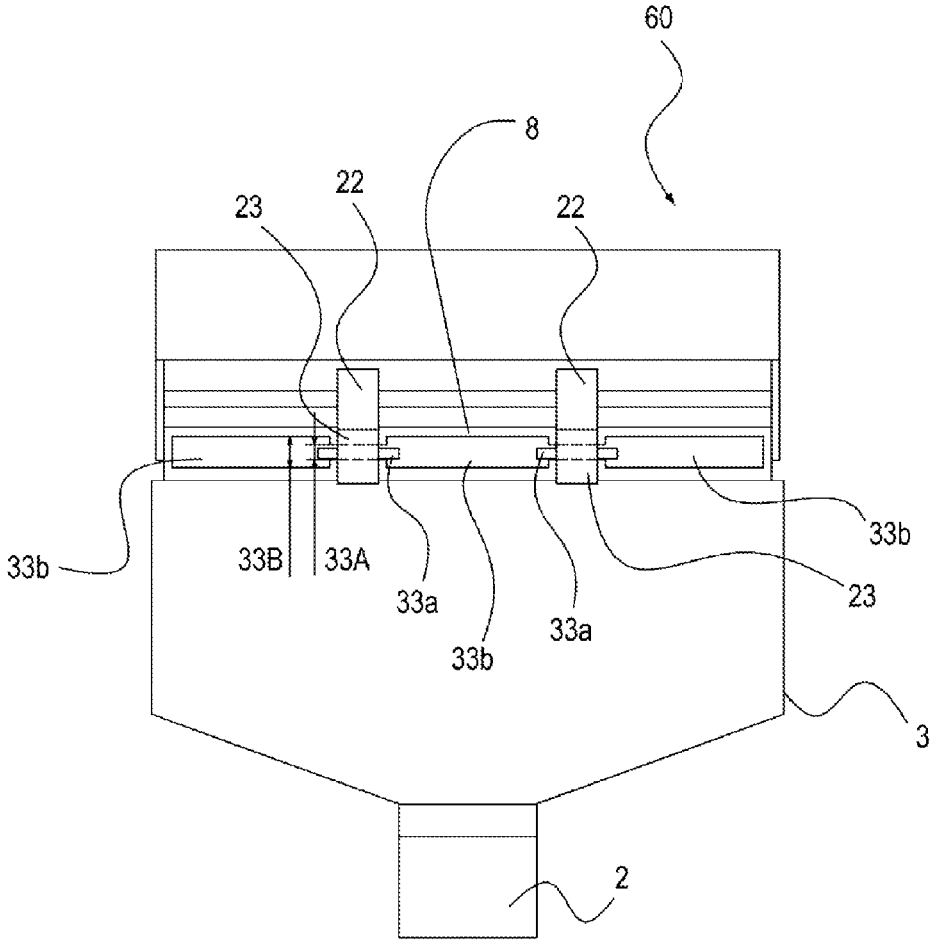
FIG. 6 is a top view explanatory diagram illustrating a configuration in proximity to the conveying portion of the image forming apparatus of the second embodiment.

As illustrated in FIGS. 5 to 7, the blowing ports 33*a*, 33*b* include the blowing port 33*a* facing the discharge roller 22 and the discharge driven roller 23 with an air-discharge wall 10 and the blowing port 33*b* not facing the discharge roller 22 and the discharge driven roller 23.

As illustrated in FIG. 7, the opening width 33A of the blowing port 33*a* is smaller than the opening width 33B of the blowing port 33*b*. Accordingly, the external air 11 discharged from the blowing port 33*b* not facing the discharge roller 22 and the discharge driven roller 23 cools the recording material 14. In this case, a large amount of air is blown onto the surface of the recording material 14 discharged by being sandwiched and conveyed by the discharge roller 22 and the discharge driven roller 23, provided in the fixing device 60 to cool the recording material 14.

On the other hand, since the opening width 33A is small, there is small amount of external air 11 discharged from the blowing port 33*a* facing the discharge roller 22 and the discharge driven roller 23. Therefore, the discharge roller 22 and the discharge driven roller 23 are difficult to be cooled.

Accordingly, the toner image heated and pressurized by the fixing film 20 and the pressure roller 21 of the fixing device 60 is fixed onto the recording material 14. Thereafter, the toner image is prevented from being melted again, because of the high-temperature recording material 14 sandwiched and conveyed by the discharge roller 22 and the discharge driven roller 23 and discharged onto a stacking portion 24.

Further, the temperature difference between the recording material 14 discharged immediately after the heating and fixing process in the fixing device 60 and the discharge driven roller 23 and discharge roller 22 can be reduced, and unevenness of cooling of the toner image due to the temperature difference between the recording material 14 and the discharge driven roller 23 and discharge roller 22 can be prevented. The other portions of this configuration are configured in the same manner as the first embodiment, and the same effects can be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2013-075601, filed Apr. 1, 2013, which is hereby incorporated by reference herein in its entirety.

What is claimed is:

1. An image forming apparatus comprising:

a toner image forming portion configured to form a toner image on a recording material;

a fixing portion configured to fix the toner image formed by the toner image forming portion onto the recording material;

a first pair of rollers which is provided at-a downstream in a conveying direction of the recording material with respect to the fixing portion, and which sandwiches and conveys the recording material;

a second pair of rollers which is provided downstream in the conveying direction with respect to the fixing portion, and which sandwiches and conveys the recording material, the first pair of rollers and the second pair of rollers being positioned at a different position in a width direction perpendicular to the conveying direction;

an air-blowing portion configured to blow air; and a guide portion configured to guide the air blown by the air-blowing portion to the recording material conveyed by the first and second pairs of rollers, wherein the guide portion includes a first blowing port positioned between the first pair of rollers and the second pair of rollers in the width direction.

2. The image forming apparatus according to claim 1, wherein the first blowing port is provided at a position overlapping a first rotation body and a second rotation body in the conveying direction, wherein the first rotation body is one of the first pair of rollers and the second rotation body is one of the second pair of rollers.

3. The image forming apparatus according to claim 1, wherein the first blowing port is provided at a position overlapping a first rotation body and a second rotation body, in a diameter direction of the first rotation body and the second rotation body, wherein the first rotation body is one of the first pair of rollers and the second rotation body is one of the second pair of rollers.

4. The image forming apparatus according to claim 1, wherein the first pair of rollers and the second pair of rollers are positioned at the same position in the conveying direction.

5. The image forming apparatus according to claim 1, wherein the first pair of rollers and the second pair of rollers are discharge roller pairs which discharge the recording material to outside of a main body of the apparatus.

6. The image forming apparatus according to claim 5, wherein air blow out from the first blowing port to the recording material flows above the main body of the apparatus.

7. The image forming apparatus according to claim 1, wherein each of the first pair of rollers and the second pair of rollers includes a driving rotation body and a driven rotation body which rotates by being driven by the driving rotation body, and a rotation shaft of the driven rotation body is attached to the guide portion.

8. An image forming apparatus comprising:

a toner image forming portion configured to form a toner image on a recording material;

a fixing portion configured to fix the toner image formed by the toner image forming portion onto the recording material;

a pair of rollers which is provided downstream in a conveying direction of the recording material with respect to the fixing portion, and which sandwiches and conveys the recording material;

an air-blowing portion configured to blow air; and a guide portion configured to guide the air blown by the air-blowing portion to the recording material conveyed by the pair of rollers, wherein the guide portion includes blowing ports at a position facing the pair of rollers and a position not facing the pair of rollers, and wherein in a direction in which the pair of rollers conveys the recording material, the blowing port at the position facing the pair of rollers is smaller than the blowing port at the position not facing the pair of rollers.

9. The image forming apparatus according to claim 1, wherein the position of the first blowing port, the position of the first pair of rollers and the position of the second pair of rollers are different in the width direction.

10. The image forming apparatus according to claim 1, wherein the guide portion includes a closing portion which closes the air blown from the air-blowing portion, the closing portion overlapping the first pair of rollers and the second pair of rollers in the width direction.

11. The image forming apparatus according to claim 1, wherein the air-blowing portion blows air toward an under surface of the recording material through the first blowing port.

12. The image forming apparatus according to claim 1, wherein the guide portion includes a second blowing port positioned outside of the first pair of rollers in the width direction and a third blowing port positioned outside of the second pair of rollers in the width direction.

13. An image forming apparatus comprising:

a toner image forming portion configured to form a toner image on a recording material;

a fixing portion configured to fix the toner image formed by the toner image forming portion onto the recording material;

a first discharge roller which is provided downstream in a conveying direction of the recording material with respect to the fixing portion, and which conveys the recording material;

a second discharge roller which is provided downstream in the conveying direction with respect to the fixing portion, and conveys the recording material, wherein the first discharge roller and the second discharge roller are positioned at a different position in a width direction perpendicular to the conveying direction;

an air-blowing portion configured to blow air; and a guide portion configured to guide the air blown by the air-blowing portion to the recording material conveyed by the pair of rollers, wherein the guide portion includes a first blowing port positioned between the first discharge roller and the second discharge roller in the width direction.

14. The image forming apparatus according to claim 13, wherein the first blowing port is provided at a position overlapping the first discharge roller and the second discharge roller in the conveying direction.

15. The image forming apparatus according to claim 13, wherein the first blowing port is provided at a position overlapping the first discharge roller and the second discharge roller in a diameter direction of the first discharge roller and the second discharge roller.

16. The image forming apparatus according to claim 13, wherein the first discharge roller and the second discharge roller are positioned at the same position in the conveying direction.

17. The image forming apparatus according to claim 13, wherein the air-blowing portion blows air toward an under surface of the recording material through the first blowing port.

18. The image forming apparatus according to claim 13, wherein the position of the first blowing port, the position of the first discharge roller, and the position of the second discharge roller are different in the width direction.

19. The image forming apparatus according to claim 13, wherein the guide portion includes a closing portion closing the air blown from the air-blowing portion, wherein the closing portion overlaps the first discharge roller and the second discharge roller in the width direction.

20. The image forming apparatus according to claim 13, wherein the guide portion includes a second blowing port positioned outside of the first discharge roller in the width direction and a third blowing port positioned outside of the second discharge roller in the width direction.

21. The image forming apparatus according to claim 1, wherein the first blowing port is provided on the center of the recording material in the width direction.

22. The image forming apparatus according to claim 13, wherein the first blowing port is provided on the center of the recording material in the width direction.

* * * * *